United States Patent [19]

Vanassche et al.

[11] 4,059,450

[45] Nov. 22, 1977

[54] DIRECT POSITIVE SILVER HALIDE ELEMENTS

[75] Inventors: Willy Joseph Vanassche, Kontich; Herman Alberik Pattyn, Kapellen, both of Belgium; Erik Moisar; Sieghart Klotzer, both of Cologne, Germany

[73] Assignee: AGFA-GEVAERT N.V., Mortsel, Belgium

[21] Appl. No.: 417,499

[22] Filed: Nov. 20, 1973

[30] Foreign Application Priority Data

Dec. 8, 1972 Germany ..... 2260117

[51] Int. Cl.[2] ..... G03C 1/36; G03C 1/28

[52] U.S. Cl. ..... 96/101; 96/107; 96/108; 96/120

[58] Field of Search ..... 96/101, 120, 107, 108

[56] References Cited

U.S. PATENT DOCUMENTS

| | | | |
|---|---|---|---|
| 3,320,069 | 5/1967 | Illingsworth | 96/107 |
| 3,367,778 | 2/1968 | Berriman | 96/107 |
| 3,531,290 | 9/1970 | Litzerman | 96/107 |
| 3,647,455 | 3/1972 | Burt et al. | 96/64 |
| 3,740,226 | 6/1973 | Dappen | 96/64 |
| 3,759,713 | 9/1973 | Florens | 96/108 |

*Primary Examiner*—Won H. Louie, Jr.
*Attorney, Agent, or Firm*—A. W. Breiner

[57] ABSTRACT

Direct positive silver halide emulsions are provided which contain fogged silver halide grains with a layered grain structure wherein the external shell of the silver halide grains comprise up to 20 mole % of silver iodide based on the silver halide of the shell. The emulsions show improved sensitivity and produce images of improved maximum density.

23 Claims, No Drawings

DIRECT POSITIVE SILVER HALIDE ELEMENTS

This invention relates to photographic materials containing at least one direct positive silver halide emulsion layer with improved sensitivity to light.

Direct positive images are generally produced by exposing or chemically treating fogged silver halide emulsions. If certain conditions are observed, the developable fog is destroyed in the light struck areas but remains intact in the unexposed areas. Development of the emulsion after exposure results in a direct positive image. Destruction of the developable fog by image wise exposure is achieved mainly by utilizing the Herschel effect or the solarisation effect. In the former case, exposure is carried out with long wave light from the absorption range of silver so that the silver nuclei are destroyed in the light struck areas. In the case of the solarisation effect, on the other hand, exposure is carried out with shortwave light from the absorption range of the silver halide. This also leads to destruction of the developable fog. These processes have remained of minor importance in practice because the usual photographic emulsions have but a relatively low sensitivity.

It has been described in the article by E. Moisar and S. Wagner in "Berichte der Bunsengesellschaft fuer physikalische Chemie" 67 (1963) 356–359, that the sensitivity to light of fogged direct positive silver halide emulsions can be increased by incorporating ripening nuclei into the interior of the silver halide grain in order to trap in the interior of the grain the photoelectrons, which are formed in the primary process and which prevent destruction of the developable fog nuclei at the surface of the grain. The preparation of such emulsions has been described in German Pat. No. 1,169,290. An increase in the sensitivity to light can also be obtained in the fogged silver halide emulsions, which are free from internal nuclei, by adding desensitizing dyes in accordance with U.K. Pat. Specification No. 723,019.

It is an object of this invention to produce direct positive surface fogged silver halide emulsions which have improved sensitivity to light.

A photographic material containing at least one silver halide emulsion layer, which contains a direct positive, surface fogged silver halide emulsion with a layered grain structure has now been found in which the silver halide of the fogged external shell contains up to 20 mole % of silver iodide.

The silver iodide content of this external shell in such direct positive silver halide emulsions is preferably between 10 and 20 mole %, based on the silver halide content in this shell. The volume of the external shell, which contains the silver iodide may be up to 75% of the total volume of the grain. Those silver halide emulsions, in which the volume of the external shell amounts to 5 to 50% of the total grain volume are preferred. According to a particularly preferred embodiment, the proportion by volume of the external shell is 5 to 15%, based on the total volume of the grain.

The fogged direct positive emulsions to be used according to the invention have substantially higher sensitivity and in most cases also a higher maximum density than those emulsions, which are free from iodide or which have a homogeneous silver iodide content in the grain.

The direct positive silver halide emulsions according to this invention are preferably prepared by first producing the core of the silver halide grains free from silver iodide by precipitation under the usual conditions and then depositing the shell, which contains silver iodide, on this grain by precipitation. Conversion of a silver halide emulsion, which is free from silver iodide, by treating it with a solution of alkali metal iodide is less suitable.

The emulsions used in the photographic material according to the invention may be either heterodisperse, irregular emulsions or also homodisperse emulsions with a regular crystal habit.

The simplest method of preparing heterodisperse emulsions consists in adding an aqueous silver salt solution, preferably a silver nitrate solution, to a gelatin-containing solution of the other precipitation component. The precipitation components used are preferably aqueous solutions of alkali metal halides. The desired average grain size and grain size distribution can be modified in known manner by adding an excess of halide and by suitably adjusting the conditions, in which physical ripening takes place, in particular the temperature and time. If homodisperse emulsions with a narrow grain size distribution are used, it is preferable to use those, in which about 95% by weight of the silver halide grains have a diameter, which does not deviate by more than 40%, and preferably not more than 30%, from the average grain diameter.

Those direct positive silver halide emulsions are preferred in which the silver halide grains have an average diameter of less than about 1 micron, preferably less than 0.5 micron. The silver halide grains may have any of the known forms, e.g. they may be cubical, octahedral or rhombohedral.

The homodisperse silver halide emulsions are preferably prepared by the known double inflow process.

The silver halide envelopes, which contain iodide are then precipitated on the heterodisperse or homodisperse silver halide grains, which have been prepared by the process outlined above. This precipitation may be carried out by any method desired. It may either be carried out, as in the case of precipitation of the nuclei, by adding silver nitrate to the other precipitation component or it may be carried out by simultaneous inflow of both precipitation components or by alternately adding one and the other component. Salts of polyvalent cations such as bismuth salts may advantageously be present in the process of precipitation. After precipitation, the product is worked up in the usual manner by flocculating, washing, etc.

According to a preferred embodiment of the present invention emulsions are used having silver halide grains containing interior electron traps. They comprise silver halide grains having internal centres promoting the deposition of photolytic silver. Such direct-positive silver halide emulsions have improved sensitivity as shown by E. Moisar and S. Wagner in "Berichte der Bunsengesellschaft fuer physikalische Chemie" 67 (1963) 356–359. Photographic emulsions comprising in the interior of the silver halide grains centres promoting the deposition of photolytic silver can be prepared, e.g., as described in the U.K. Pat. Specification No. 1,027,146 of Agfa A. G. filed Aug. 30, 1963. For this purpose, a homodisperse fine-grain silver halide emulsion with narrow grain size distribution is made first, preferably by the double jet silver halide precipitating technique. These fine silver halide grains will serve as the cores for the final emulsion.

The silver halide cores thus formed are then treated so as to produce centres that promote the deposition of photolytic silver (electron traps) on the cores. For this purpose, the cores may be treated chemically or physically according to any of the known procedures for producing ripening nuclei i.e. latent image nucleating centres. Such procedures are described, e.g., by A. Hautot and H. Sauvenier in "Sci.et Ind.Phot.", Vol.XXVIII, January 1957, p.1–23 and 57–65.

The ripening nuclei can be formed by chemical sensitization by means of noble metal compounds, especially gold or iridium compounds e.g. the alkaline metal salts of the following noble metal ions $[Au(S_2O_3)_2]^{3-}$, $[Au(SCN)_2]^-$, $[IrX_6]^{3-}$ and $[IrX_6]^{4-}$ wherein X is halogen, by means of sulphur compounds, e.g. thiosulphates, or by means of both noble metal compounds and sulphur compounds. Ripening of the silver halide cores can also be effected by means of reducing agents, e.g. hydrazine thiourea or tin(II)chloride, optionally together with nobel metal compounds.

Electron traps can further be provided by treating the silver halide cores with aqueous solutions of salts of polyvalent metals e.g. of the trivalent bismuth.

It is also possible to use the compounds suitable for the formation of the electron traps, e.g. the chemical sensitizers referred to hereinbefore, during the precipitation of the fine-grain silver halide i.e. during the formation of the cores for the final silver halide emulsion. In this way, the electron traps are distributed statistically in the interior of the cores contrary to when the compounds are added after the formation of the fine-grain silver halide where the electron traps are formed substantially at the surface of the cores. After the formation of the cores having centres promoting the deposition of photolytic silver, silver halide precipitation is continued to form around the cores an outer shell of silver halide.

Another type of preferred direct-positive silver halide emulsions for use in accordance with the present invention are emulsions that comprise no interior ripening nuclei but exterior electron-traps by the presence of one or more electron-accepting or desensitizing compounds as described e.g. in the U.K. Pat. Specification No. 723,019. By adsorption of these electron acceptors to the surface of the silver halide grains improved photosensitivity is obtained.

Other direct positive emulsions which are suitable for this invention have been described in the German Pat. Nos. 606,392 and 642,222 and in the U.K. Pat. Specifications Nos. 581,773 and 655,009. The emulsions may also contain mercury salts or thallium salts as described in the published German Pat. Application No. 1,622,256.

The direct positive silver halide emulsions according to the present invention can thus be prepared by the steps of first forming silver halide cores that are substantially free from silver iodide and optionally treating these cores so as to produce centres promoting the deposition of photolytic silver as described above, precipitating over these cores a shell of silver halide comprising up to 20 mole % of silver iodide based on the silver halide of the shell, and fogging the silver halide grains thus formed.

Fogging of the silver halide grains can occur in any suitable known manner, which consists of providing the silver halide grains with silver nuclei and/or nuclei of a metal more electropositive than silver including gold, platinum, palladium, iridium, etc.

The silver halide grains may be provided with silver nuclei e.g. by an overall uniform exposure to actinic radiation and preferably by reduction sensitization, e.g. by high pH and/or low pAg silver halide precipitation or digestion conditions e.g. as described by Wood, J. Phot. Sci. 1 (1953) 163, or by treatment with reducing agents e.g. tin(II)salts e.g. tin(II)chloride, tin complexes and tin chelates of the (poly)amino(poly)carboxylic acid type as described in the U.K. Pat. No. 1,209,050 filed Dec. 27, 1967 by Agfa-Gevaert N. V., formaldehyde, hydrazine, hydroxylamine, sulphur compounds such as thiourea dioxide, phosphonium salts such as tetra(hydroxymethyl)-phosphonium chloride, polyamines such as diethylenetriamine, bis(p-aminoethyl)-sulphide and its water-soluble salts, etc.; preferred reducing agents are thiourea dioxide and tin(II)chloride.

The silver halide grains can also be provided with nuclei of a metal more electropositive than silver, for example, by treatment of the silver halide grains (which may have been provided with silver nuclei) with a compound of a metal more electropositive than silver, preferably in the form of water-soluble salts e.g. potassium chloroaurate, gold(III)chloride, ammonium hexachloropalladate, potassium chloroiridate and the like. The treatment with a gold compound may occur by means of a mixture of a water-soluble noble metal compound e.g. gold(III)chloride and thiocyanates forming complexes with gold and having a solvent action on the silver halide grains, e.g. alkali metal and ammonium thiocyanates.

In the formation of direct-positive silver halide emulsions, fogging of the silver halide grains is very suitably effected by reduction sensitization e.g. by high pH and/or low pAg digestion conditions or by means of a reducing agent e.g. thiourea dioxide together with a compound of a metal more electropositive than silver, especially a gold compound. The reducing agent is preferably used initially and the gold compound subsequently. However, the reverse order can be used or both compounds can be used simultaneously.

The degree of fogging of the direct-positive silver halide emulsions may vary within a very wide range. It is generally sufficient to use about 0.0005 to about 0.06 milliequivalents of reducing agents and about 0.001 to about 0.01 millimoles of the noble metal salt per mole of silver halide as described in the published German Pat. Application No. 1,547,790. If the emulsions have been fogged too heavily, they may subsequently be treated with a bleaching agent in known manner to adjust the light sensitivity of the direct positive emulsions to the optimum level.

As is known in the art, the degree of fogging not only depends on the concentration of the fogging agents used but also on the pH, the pAg, the temperature, and the duration of the fogging treatment. High photographic speeds are obtained at low degrees of fogging as is illustrated in the U.S. Pat. No. 3,501,307 of Bernard D. Illingsworth issued Mar. 17, 1970 and the U.K. Pat. Application No. 7742/72 filed Feb. 18, 1972 by Agfa-Gevaert N. V.

In the U.S. Pat. No. 3,501,307 as mentioned above direct-positive silver halide emulsions comprising fogged silver halide grains and a compound accepting electrons, are described wherein the grains are fogged to such an extent that a test portion of the emulsion when coated on a support to give a maximum density of at least about 1, upon processing for 6 minutes at about 20° C in a developer of the composition given hereinafter shows a maximum density at least about 30% higher than the maximum density of an identical test portion processed for 6 minutes at about 20° C in such developer after bleaching for about 10 minutes at about 20° C in a bleaching bath having the composition given hereinafter.

| | |
|---|---|
| Bleaching bath | |
| potassium cyanide | 50 mg |
| glacial acetic acid | 3.47 ml |
| sodium acetate | 11.49 g |
| potassium bromide | 119 mg |
| water to make | 1 liter |
| Developer | |
| N-methyl-p-aminophenol sulphate | 2.5 g |
| sodium sulphite | 30.0 g |
| hydroquinone | 2.5 g |
| sodium metaborate | 10.0 g |
| potassium bromide | 0.5 g |
| water to make | 1 liter |

According to the copending U.K. Patent Application No. 7742/72 as mentioned above the silver halide grains are fogged to such an extent that a test portion of the emulsion, when coated on a support at a ratio of 0.50 g to 5.50 g of silver per sq.m gives a density of less than 0.50 upon processing without exposure for 6 min. at 20° C in the above developer and an identical test portion thereof when coated in an identical way gives a density of at least twice the value of the density of the first test portion and a density of at least 0.50 upon processing without exposure for 3 minutes at 20° C in a developer of the following composition:

| | |
|---|---|
| hydroquinone | 15 g |
| 1-phenyl-3-pyrazolidinone | 1 g |
| trisodium salt of ethylenediamine-tetraacetic acid | 1 g |
| anhydrous sodium carbonate | 30 g |
| anhydrous soidum sulphite | 70 g |
| 40 % aqueous sodium hydroxide | 16 ml |
| water to make | 1 liter (pH : 11) |

As a consequence, the terms "fogged" and "fogging" as used herein are employed in a very broad sense so that the very low degrees of fogging as defined in the above copending British Patent Application are also embraced. This means that, in accordance with the present invention, fogging is effected to such extent that a test portion of the emulsion when coated on a support at a coverage of 0.50 to 5.50 g of silver per sq.m., gives a density of at least 0.50 upon processing for 3 minutes at 20° C in the above latter developer composition.

As already indicated above, the sensitivity to light of fogged direct positive emulsions that are free from internal nuclei can be improved by the addition of desensitizers that are absorbed on the surface of the grain and act as electron traps.

According to Sheppart el al J.Phys.Chem. 50 (1946) 210, Stanienda, Z.Phys.Chem. (NF) 32 (1962) 238, and Dähne, Wiss. Phot. (1969) 161, desensitizers are dyestuffs whose cathodic polarographic half-wave potential, measured against the calomel electrode, is more positive than −1.0 V. Such compounds have also been described in the U.S. Pat. Nos. 3,501,305, 3,501,306, and 3,501,307 all of Bernard D. Illingsworth issued Mar. 17, 1970. The sensitizers described in the German Pat. No. 1,153,246 filed Apr. 11, 1962 by Agfa A. G. and U.S. Pat. No. 3,314,796 of Johannes Götze, August Randolph and Oskar Riester issued April 18, 1967 are also suitable for this purpose as well as imidazo-quinoxaline dyestuffs, e.g. those described in the Belgian Pat. No. 660,253 filed Feb. 25, 1965 by Kodak Co.

It is known to characterize these electron-accepting or desensitizing compounds by means of their polarographic half-wave potential. Electron acceptors suitable for use in the direct-positive silver halide emulsions of the present invention have an anodic polarographic half-wave potential and a cathodic polarographic half-wave potential that when added together give a positive sum. Methods of determining these polarographic half-wave potentials have been described, e.g., in the U.S. Pat. Nos. 3,501,310 of Bernard D. Illingsworth issued Mar. 17, 1970 and 3,531,290 of Roberta A. Litzerman issued Sept. 29, 1970.

The electron-accepting compounds preferably have spectrally sensitizing properties although it is possible to use electron-accepting compounds that do not spectrally sensitize the emulsion.

In the preparation of the direct-positive photographic silver halide emulsion for use in accordance with the present invention gelatin is preferably used as binder for the silver halide grains. However, the gelatin may be wholly or partly replaced by other natural hydrophilic colloids, e.g. albumin, zein, agar-agar, gum arabic, alginic acid, and derivatives thereof e.g. salts, amides and esters, starch and derivatives thereof, cellulose derivatives e.g. cellulose ethers, partially hydrolyzed cellulose acetate carboxymethyl cellulose, etc. or synthetic hydrophilic resins, for example polyvinyl alcohol, polyvinyl pyrrolidone, homo- and copolymers of acrylic and methacrylic acid or derivatives e.g. esters, amides and nitriles, vinyl polymers e.g. vinyl ethers and vinyl esters.

The direct positive silver halide emulsions for use in accordance with the present invention may comprise all kinds of emulsion ingredients suitable for direct positive emulsions. They may comprise e.g. speed-increasing compounds such as polyalkylene glycols, cationic surface-active agents of the ammonium, sulphonium and phosphonium type, thioethers, etc. They may further comprise known antifoggants and stabilizers, which include thiazolium salts, azaindenes, e.g. hydroxytetraazaindenes such as 5-methyl-7-hydroxy-s-triazolo[1,5-a]pyrimidine, mercury compounds e.g mercury oxide, mercury chloride, mercury cyanide, nitroindazoles, nitrobenzimidazoles, mercaptotetrazoles such as 1-phenyl-5-mercaptotetrazole, etc. They may comprise as compounds increasing the reversal speed of direct-positive silver halide emulsions selenium compounds of the kind described in the Belgian Pat. No. 763,827 filed Mar. 5, 1971 by Gevaert-Agfa N. V., quinone compounds of the kind described in the U.S. Defensive Publication No. T883,031 of Paul B. Gilman Jr., and Frederik J. Rauner issued Feb. 23, 1971, polymeric as well as non-polymeric 1,2- and 1,4-dihydroxybenzene compounds e.g. 2-chlorohydroquinone, tetrachlorohydroquinone, pyrocatechol, the polymeric reaction product of quinone with ammonia prepared as described in Wysokomolekularnye Soedinenya, 1968, Part A(X), Nr.8, p. 1890 by Berlin et al in which the hydroquinone or quinone recurring units are interlinked by —NH— units, and other related polymeric compounds having interlinking —S— and —O— units, as well as polymeric compounds comprising hydroquinone substituents, e.g. those described in the U.S. Pat. Nos. 3,165,495 of Lloyd D. Taylor issued Jan. 21, 1965 and 3,186,970 of Norman W. Schuler issued June 1, 1965.

Spectrally sensitizing dyes that are not electron-accepting such as e.g. cyanines, merocyanines, complex (trinuclear) cyanines, complex (trinuclear) merocyanines, styryls, and hemicyanines may also be present in the emulsion.

The direct positive emulsions may also contain compounds increasing the blue sensitivity, e.g. according to the U.K. Pat. Specification No. 1,186,718. Compounds of this type have an anodic polarographic potential of less than 0.85 and a cathodic polarographic potential with a value that is more negative than −1.0. Suitable sensitizers have also been described e.g. in the U.S. Pat. No. 3,531,290.

Further, colour couplers may be incorporated into the direct positive emulsions employed in the present invention. Particularly suitable are colour couplers showing a low halogen-accepting character, which can be determined by the test described by R. P. Held in Phot.Sci.Eng. Vol.11, (1967) p.406. For this purpose a dispersion of silver bromide grains in buffered 0.1 N potassium bromide is illuminated and the potential is registered by means of a calomel/platinum electrode system. During illumination the platinum electrode potential rises rapidly to the redox potential of bromine. On addition of a colour coupler the potential rise can be delayed through "halogen acceptance" by the colour coupler. Colour couplers as well as other emulsion ingredients including binding agents for the silver halide that do not delay or do not substantially delay the potential rise are particularly suitable for use in direct-positive silver halide emulsions.

The colour couplers can be incorporated into the direct positive photographic silver halide emulsion using any suitable technique known to those skilled in the art for incorporating colour couplers in silver halide emulsions. For example, water-soluble colour couplers e.g. those containing one or more sulpho or carboxyl groups (in acid or salt form) can be incorporated from an aqueous solution, if necessary, in the presence of alkali and the water-insoluble or insufficiently water-soluble colour couplers from a solution in the appropriate water-miscible or water-immiscible high-boiling (oil-former) or low-boiling organic solvents or mixtures of solvents, which solution is dispersed, if necessary in the presence of a surface-active agent, in a hydrophilic colloid composition forming or forming part of the binding agent of the silver halide emulsion; if necessary, the low-boiling solvent can be removed afterwards by evaporation.

The silver halide emulsion layer and other hydrophilic colloid layers of a direct-positive photographic material employed in accordance with the present invention may be hardened by means of organic or inorganic hardeners commonly employed in photographic silver halide elements, e.g. the aldehydes and blocked aldehydes such as formaldehyde, dialdehydes, hydroxyaldehydes, mucochloric and mucobromic acid, acrolein, glyoxal, sulphonyl halides and vinyl sulphones, etc.

The direct-positive photographic silver halide elements may further contain antistatic agents, wetting agents as coating aids, e.g. saponin and synthetic surface-active compounds, plasticizers, matting agents, e.g. starch, silica, polymethyl methacrylate, zinc oxide, titanium dioxide, etc., optical brightening agents including stilbene, triazine, oxazole and coumarin brightening agents, light-absorbing materials and filter dyes, mordanting agents for anionic compounds, etc.

The sensitivity and stability of the direct positive silver halide emulsions can also be improved by reducing their pH before casting, preferably to about 5, and/or increasing the pAg of the emulsion, preferably to a value which corresponds to an EMF of +30 mV or less (silver against saturated calomel electrode) in accordance with the U.K. Pat. Application No. 32,889/72.

The direct-positive silver halide emulsions can be coated on one or both sides of a wide variety of supports, which include opaque supports e.g. paper and metal supports as well as transparent supports e.g. glass, cellulose nitrate film, cellulose ester film, polyvinyl acetal film, polystyrene film, polyethylene terephthalate film, polycarbonate film and other films of resinous materials. It is also possible to use paper coated with α-olefin polymers e.g. paper coated with polyethylene, polypropylene, ethylenebutene copolymers etc.

Development of the exposed direct-positive silver halide emulsions of the invention may occur in alkaline solutions containing conventional developing agents such as hydroquinones, catechols, aminophenols, 3-pyrazolidinones, phenylenediamines, ascorbic acid and derivatives, hydroxylamines, etc. or combinations of developing agents. The exposed direct-positive emulsions may be developed to produce direct-positive black-and-white images or they may be developed to produce direct-positive colour images by means of aromatic primary amino colour developing agents, more particularly the known p-phenylenediamine developing agents, in the presence of colour couplers, which are incorporated in the emulsion or in the developing composition.

Development may occur by means of a combination of developing agents that have a superadditive action, e.g. hydroquinone together with N-methyl-p-aminophenol sulphate or other p-aminophenol derivatives and hydroquinone or a p-phenylenediamine colour developing agent together with 1-phenyl-3-pyrazolidinone or other 3-pyrazolidinone derivatives.

It may be advantageous to effect development of the exposed direct-positive silver halide emulsions with compositions substantially free from halide ions. Development with developing compositions substantially free from halide ions is particularly favourable in order to obtain high maximum densities for direct-positive silver halide emulsions, the silver halide grains of which have been fogged to a very low degree.

One or more developing agents may be incorporated in the direct-positive photographic element. They may be incorporated into the silver halide emulsion itself and/or elsewhere in the photographic element. Development can then be effected by means of an alakaline processing solution called development activator solution, which is substantially free of developing agents.

In processing the photographic materials of the invention the processing solutions can become easily stained, especially when the outer shell of the silver halide grains has a high silver iodide content. Therefore, the processing solution used to effect development of the exposed direct-positive silver halide emulsion and which comprises or does not comprise one or more developing agents is preferably supplied in an amount that suffices for the treatment of exactly one piece of light-sensitive element. Therefore, it is preferred to employ a single-use bath. A bath of this type offers the advantage that ageing and contamination of the bath composition are eliminated. For one-time use the processing solution is preferably relatively viscous so as to be easily controlled when spread. Viscous processing solutions can be obtained by addition of a thickening agent, e.g. a water-soluble polymer. The film-forming plastic may be any of the high molecular weight polymers that are stable to alkali and that are soluble in aqueous alkaline solutions e.g. hydroxyethylcellulose, starch or gum, polyvinyl alcohol, the sodium salts or polymethacrylic acid and polyacrylic acid, sodium alginate, sodium carboxymethyl cellulose etc. The relatively viscous processing composition may be confined within a container, which is ruptured at the moment of development as is done, for example, in the well-known silver complex diffusion transfer process for in-camera processing.

Photographic materials, which contain at least one of the direct positive silver salt emulsion layers according to the invention may be used for various photographic purposes, e.g. as materials with a steep gradation for reprographic purposes, as direct positive X-ray films, for producing direct positive colour images, e.g. by the silver dye bleaching process or the dye diffusion process, or for producing photographic colour images by conventional methods of chromogenic development.

In these direct positive emulsions, the grains may also be provided with a thin protective envelope to improve the fog stability as described in the published German Patent Application No. 2,216,075.

EXAMPLE 1

A homodisperse direct positive silver bromide emulsion of cubic silver bromide with an average particle diameter of 0.1 micron is prepared by precipitating the silver halide at pH 4, pAg 8.2 and a temperature of 40° C.

After precipitation, the emulsion is divided into 4 equal samples, A, B, C, and D. Each sample contains a quantity of silver bromide corresponding to 315 g of silver nitrate.

In each sample, precipitation is continued at 40° C by simultaneously adding the following aqueous solutions:

126 ml of 3 molar silver nitrate solution 126 ml of 3 molar potassium halide solution.

In sample A, the potassium halide solution is a pure potassium bromide solution and in samples B to D the potassium bromide solution contains, respectively, 5, 10 and 15 mole % of potassium iodide, based on the total quantity of potassium halide.

After 30 minutes, gelatin is added in such a quantity that the proportion of gelatin to silver nitrate is about 1:4, and ripening is continued until complete dissolution.

The emulsions are then solidified by cooling, size reduced, and washed with cold water. Emulsions B to D contain silver halide grains, which consist of a silver bromide core and a shell of silver iodobromide. The silver iodbromide shell constitutes about 17 volume % of the total volume of the grain.

For comparison, 4 equally monodisperse direct positive emulsions E to H with cubic crystals and the same silver halide content are prepared but with this difference that potassium iodide (in the same quantities as for portions B to D) is added to emulsions F to H during the whole time of precipitation.

The emulsions are fogged by ripening them at pH 7 at a temperature of 60° C and at a low pAg value, which corresponds to the EMF values indicated in the following Table (silver electrode against the saturated calomel electrode), in the presence of 12 mg of potassium chloroaurate per mole of silver halide.

After the addition of 600 mg of Pinacryptol yellow as desensitizer and 600 mg of the following optical sensitizer per mole of silver halide:

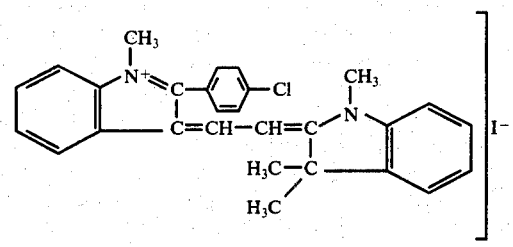

the emulsions are coated on a layer support of cellulose acetate in a quantity corresponding to 3.75 g of silver and 3.75 g of gelatin per m2.

The emulsions are then dried, exposed in a sensitometer, and developed for 2 minutes at 20° C in a developer of the following composition:

| | |
|---|---|
| water | 800 ml |
| p-monomethyl-aminophenol sulphate | 1.5 g |
| sodium sulphite | 50.0 g |
| hydroquinone | 6.0 g |
| anhydrous sodium carbonate | 32.0 g |
| potassium bromide | 2.0 g |
| made up with water to 1 liter | |

After development, the emulsions are fixed, washed, and dried in the usual manner. The results of sensitometric determination are shown in the following table. The values given for the sensitivity are relative values. The value of solutions, which contain no silver iodide, is taken to be 100. The sensitivity is measured at a density of 0.1 below the maximum.

Table

| Emulsion | pAg (EMF) during ripening | Ripening time | relative sensitivity | $D_{min}$ | $D_{max}$ |
|---|---|---|---|---|---|
| A | +300 | 3 hours 30 min. | 100 | 0.06 | 1.48 |
| B | +240 | 2 hours | 263 | 0.04 | 3.00 |
| C | +230 | 1 hour 30 min. | 288 | 0.06 | 2.30 |
| D | +220 | 2 hours 30 min. | 436 | 0.08 | 2.56 |
| E | +320 | 2 hours 30 min. | 100 | 0.06 | 1.24 |
| F | +250 | 2 hours 30 min. | 123 | 0.04 | 1.33 |
| G | +240 | 2 hours 30 min. | 209 | 0.04 | 1.70 |
| H | +230 | 1 hour 30 min. | 339 | 0.06 | 1.66 |

These results show the improved sensitivity and maximum density of emulsions B to D according to the invention compared with those emulsions (F to G) in which the silver iodide is evenly distributed in the whole silver halide grain.

For a given silver iodide content, the sensitivity and maximum density can be even further increased if the iodide is close to the surface of the silver halide grains.

EXAMPLE 2

A silver chloroiodobromide emulsion A containing 85 mole % of chloride, 12.5 mole % of bromide, and 2.5 mole % of iodide is prepared by adding 75 ml of a 3-molar aqueous silver nitrate solution and 75 ml of an aqueous potassium halide solution consisting of 15 ml of 3-molar potassium iodide solution and 60 ml of a mixture of a 3 molar potassium chloride solution and 3-molar potassium bromide solution to a 7% gelatin solution in water through a double feed jet. Precipitation is then continued by adding 525 ml of 3-molar silver nitrate solution and 525 ml of a mixture of 3-molar potassium chloride solution and 3-molar potassium bromide solution. During the addition of thse reactants, the pH is kept at 3, the pAg at 6.8 and the temperature at 40° C. Emulsion A obtained in this way consists of silver halide grains, in which the silver iodide is situated mainly in the core of the grain.

A silver chloroiodobromide emulsion B containing 85 mole % of chloride, 12.5 mole % bromide and 2.5 mole % of iodide is prepared in the same way except that precipitation is first carried out with the above described 525 ml of a mixture of potassium bromide and potassium chloride and thereafter with a mixture of 15 ml of 3-molar potassium iodide and 60 ml of a mixture of 3-molar potassium chloride solution, and 3-molar potassium bromide solution.

Emulsion B obtained in this way consists of silver halide grains, in which the silver iodide is situated in the external shell of the grains. The silver chloroiodobromide shell of the grains constitutes about 12.5 volume % of the total grain volume.

Gelatin is added after 30 minutes until the gelatin/silver nitrate ratio is approximately 1:4 and ripening is continued until complete dissolution. The emulsions are solidified by cooling, size reduced, and washed with cold water.

The emulsions are fogged by ripening at pH 7, 60° C, and pAg 6.8 in the presence of 0.4 mg of thiourea dioxide per mole of silver halide. The treatment times are shown in the following Table.

Further treatment and casting of the emulsions are carried out as in Example 1. The results of sensitometric determinations, which are obtained after development in accordance with Example 1, are summarized in the following Table. The sensitivity values obtained are relative values, Emulsion A being taken to have a sensitivity of 100, and the sensitivity is measured at a density of 0.1 below the maximum.

Table

| Emulsion | Ripening time | Relative sensitivity | $D_{min}$ | $D_{max}$ |
|---|---|---|---|---|
| A | 5 hours | 100 | 0.08 | 1.46 |
| B | 2 hours 15 min. | 251 | 0.07 | 1.46 |

EXAMPLE 3

A homodisperse gelatin/silver bromide emulsion, in which the crystals have a cubical structure with a length of side of about 0.15 $\mu$, is prepared by controlled double inflow of silver nitrate and potassium bromide solutions. After the addition of $10^{-4}$ mole of $Na_3[Au(S_2O_3)_2]$ per mole of silver bromide, the emulsion is ripened for one hour at 55° C.

This emulsion is used as starting emulsion for the preparation of silver halide emulsions described in U.K. Pat. Specification No. 1,027,146, which have composite silver halide grains consisting of a central core of silver halide with centres, which favour the deposition of photolytic silver, and an external shell of silver halide.

1050 ml of an aqueous 3N silver nitrate solution and 1050 ml of a 3N potassium bromide solution are simultaneously added to a sample of the starting emulsion, which contains 0.5 mole of silver bromide, the pAg being maintained at 8.0 during this time. After addition of these two solutions, the sample contains 3.5 moles of silver halide.

The following solutions are then added simultaneously:

120 ml of 3N silver nitrate solution, 120 ml of a potassium halide solution, which has a 2.55 molar concentration of potassium bromide and a 0.45 molar concentration of potassium iodide.

The shell, which is deposited by precipitation in this way, contains 0.4 mole of silver halide. The homodisperse silver iodobromide emulsion obtained in this way contains cubic crystals with an average grain diameter of about 0.3 micron and a silver iodide content of 1.31 mole % based on the total quantity of silver halide. The grains consist of a central core of silver bromide surrounded by a shell of silver bromide, which in turn is surrounded by a thin shell of silver iodobromide having iodide content of 15 mole %. The volume of the shell is 10.2% of the total grain volume.

Another silver iodobromide emulsion with the same grain size and same iodide content is prepared for the purposes of comparison. The same method is used for preparation except that the iodide is uniformly distributed in the shell of silver halide round the silver halide core. This is achieved by adding the following aqueous solutions simultaneously to another portion of the starting emulsion, which contains 0.5 mole % of silver bromide and is kept at pAg 8.0:

1170 ml of 3N silver nitrate solution and 1170 ml of a potassium halide solution, which has a 2.955 molar concentration of potassium bromide and a 0.45 molar concentration of potassium iodide. Both emulsions are fogged by the usual method, and both to the same maximum density. The emulsions are then coated on a layer support of cellulose acetate. After exposure through a grey wedge and 5 minutes development at 20° C in a developer of the following composition:

| | |
|---|---|
| p-methylaminophenol | 1 g |
| hydroquinone | 3 g |
| anhydrous sodium sulphite | 13 g |
| anhydrous sodium carbonate | 26 g |
| potassium bromide | 1 g |
| water up to 1 liter | |

the emulsions are tested sensitometrically. The emulsion, in which the silver iodide is present in the external shell of the grains, is 6.3 times more sensitive than the comparison emulsion.

EXAMPLE 4

The emulsions described in Example 3 are spectrally sensitized by the addition of 1.5 g of the dye of the following formula:

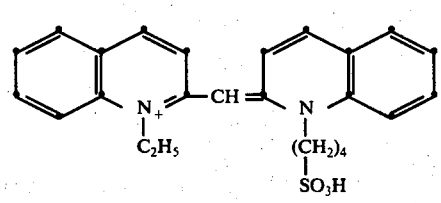

and 0.105 g of the supersensitizer of the following formula

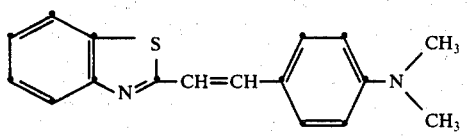

per mole of silver halide.

The emulsions are exposed through a step wedge behind a grey filter and developed as described in Example 3. The emulsion according to the invention is five times more sensitive than the comparison emulsion in the spectral region, for which the emulsion has been sensitized.

We claim:

1. Photographic material containing at least one direct-positive silver halide emulsion layer containing surface fogged silver halide grains selected from the group consisting of:

a. silver halide grains that are free of internal centers promoting the deposition of photolytic silver and have adsorbed to the surface of the grains an electron-accepting compound having an anodic polarographic half-wave potential and a cathodic polarographic half-wave potential which when added together give a positive sum, and b. silver halide grains having a central silver halide core containing centers promoting the deposition of photolytic silver and a silver halide shell coated thereover, wherein the silver halide grains have been precipitated so as to form in the silver halide grains (a) or in the silver halide shell of grains (b) an external shell of silver halide containing silver iodide in an amount up to 20 mole percent based on the silver halide of the external shell sufficient to provide an emulsion having improved sensitivity and which produces images of improved maximum density, the remainder of the silver halide grains being substantially free of silver iodide.

2. Process for the preparation of a direct-positive silver halide emulsion comprising fogged silver halide grains having adsorbed to their surface an electron-accepting compound which comprises the steps of:

1. precipitating silver halide cores that are substantially free of silver iodide and free of centers promoting the deposition of photolytic silver,
2. precipitating on the silver halide cores a shell of silver halide containing silver iodide in an amount up to 20 mole percent based on the silver halide of the shell sufficient to provide an emulsion having improved sensitivity and which produces images of improved maximum density,
3. chemically fogging the silver halide grains, and
4. adding an electron-accepting compound having an anodic polarographic half-wave potential and a cathodic polarographic half-wave potential which when added together give a positive sum.

3. Process for the preparation of a direct-positive silver halide emulsion comprising fogged silver halide grains having in their interior centers promoting the deposition of photolytic silver, which comprises the steps of:

1. precipitating silver halide cores that are substantially free of silver iodide,
2. during or after formation of the silver halide cores chemically or physically treating the cores so as to form centers promoting the deposition of photolytic silver,
3. precipitating on the silver halide cores a shell of silver halide that is substantially free of silver iodide,
4. precipitating on the shell of silver halide an external shell of silver halide containing silver iodide in an amount up to 20 mole percent based on the silver halide of the external shell sufficient to provide an emulsion having improved sensitivity and which produces images of improved maximum density, and
5. chemically fogging the silver halide grains formed.

4. Process according to claim 3, wherein the volume of the external shell containing silver iodide is up to 75 volume percent of the total volume of the grain.

5. Process according to claim 3, wherein the volume of the external shell containing silver iodide is 5 to 50 volume percent of the total volume of the grain.

6. Process according to claim 3, wherein the volume of the external shell containing silver iodide is 5 to 15 volume percent of the total volume of the grain.

7. Process according to claim 3, wherein the external shell containing silver iodide contains from 10 to 20 mole percent of the silver iodide, based on the silver halide of the shell.

8. Photographic material according to claim 1, wherein the volume of the external shell containing silver iodide is up to 75% of the volume of the total grain.

9. Photographic material according to claim 1, wherein the volume of the external shell containing silver iodide is 5 to 50vol. % of the total grain volume.

10. Photographic material according to claim 1, wherein the volume of the external shell containing silver iodide is 5 to 15 mole % of the total grain volume.

11. Photographic material according to claim 1, wherein the silver iodide content of the external shell is 10 to 20 mole % based on the total silver halide of the shell.

12. Photographic material according to claim 1, wherein said silver halide grains have been fogged by reduction sensitization.

13. Photographic material according to claim 12, wherein the said silver halide grains have been fogged by treatment of the silver halide grains with a reducing agent.

14. Photographic material according to claim 13, wherein said reducing agent is thiourea dioxide or tin-(II)chloride.

15. Photographic material according to claim 8, wherein the silver halide grains have been fogged by low pAg and/or high pH silver halide precipitating or digestion conditions.

16. Photographic material according to claim 12, wherein fogging also occurs in the presence of a compound of a metal more electropositive than silver.

17. Photographic material according to claim 16, wherein said metal compound is a gold compound.

18. Photographic material according to claim 1, wherein the emulsion has been spectrally sensitized.

19. Photographic material according to claim 1, wherein the silver halide emulsion layer is homodisperse and consists of regular crystals.

20. Process according to claim 2, wherein the volume of the shell containing silver iodide is up to 75 vol. % of the total volume of the grain.

21. Process according to claim 2, wherein the volume of the shell containing silver iodide is 5 to 50 vol. % of the total volume of the grain.

22. Process according to claim 2, wherein the volume of the shell containing silver iodide is 5 to 15 vol. % of the total volume of the grain.

23. Process according to claim 2, wherein the shell containing silver iodide contains 10 to 20 mole % of silver iodide, based on the silver halide of the shell.

* * * * *